US011004431B2

(12) United States Patent
Sands

(10) Patent No.: US 11,004,431 B2
(45) Date of Patent: May 11, 2021

(54) DRUM DAMPER

(71) Applicant: Cynthia L. Sands, Hermitage, TN (US)

(72) Inventor: Cynthia L. Sands, Hermitage, TN (US)

(73) Assignee: SNARESKIRT, LLC, Spring Hill, TN (US)

( * ) Notice: Subject to any disclaimer, the term of this patent is extended or adjusted under 35 U.S.C. 154(b) by 0 days.

(21) Appl. No.: 17/020,598

(22) Filed: Sep. 14, 2020

(65) Prior Publication Data

US 2021/0090530 A1 Mar. 25, 2021

Related U.S. Application Data

(60) Provisional application No. 62/906,087, filed on Sep. 25, 2019.

(51) Int. Cl.
*G10D 13/14* (2020.01)

(52) U.S. Cl.
CPC ..... *G10D 13/14* (2020.02)

(58) Field of Classification Search
CPC ..... G10D 13/14; G10D 3/00; G10D 13/00; G10D 3/01; G10D 13/10
See application file for complete search history.

(56) References Cited

U.S. PATENT DOCUMENTS 5,404,784 A * 4/1995 Steenbock ..... G10D 13/02 84/411 M

* cited by examiner

*Primary Examiner* — Kimberly R Lockett

(74) *Attorney, Agent, or Firm* — Eric B. Fugett; Mark A. Pitchford; Pitchford Fugett, PLLC

(57) ABSTRACT

A drum damper includes a flexible body having a lower edge and an upper portion extending from a left side to a right side. The body is formed from at least one panel of a sound damping material which is folded and secured in places to define a passage extending through the upper portion from the left side to the right side. An elastic cord having opposing first and second ends is received in the passage. The ends of the cord extend beyond the corresponding left and right sides of the body. A hook is secured to each end of the cord. When the hooks are connected to the drum, the lower edge of the body hangs below a bottom surface of the drum and reduces the perception by nearby people and microphones of piercing notes emitted from of the drum.

17 Claims, 9 Drawing Sheets

DRUM DAMPER

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims priority to U.S. Provisional Patent Application Ser. No. 62/906,087, filed Sep. 25, 2019 and titled "DRUM DAMPER," the entire disclosure of which is hereby incorporated by reference.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present invention relates generally to the field of musical instruments. More specifically, the present invention relates to devices for muting, muffling, or damping drums.

Drums have been widely used throughout human history. There are many kinds of drums in use today, including but not limited to bass drums, timbale drums, and snare drums. The snare drum in particular forms a key part of modern popular music. However, snare drums are generally known among musicians to emit an unpleasant piercing sound from the underside of the drumhead when played. This piercing sound can project forward and cause discomfort among attendees of a live musical performance and interfere with nearby vocal microphones, especially on smaller stages or in very reflective rooms.

Musicians, sound engineers, producers, and others in the music business have used various devices and methods to attempt to control this piercing sound during live performances and studio recordings. Some currently available options for reducing the piercing sound emitted by a snare drum include, for example, silicone gels and thin adhesive sheets affixed to the drum head, the use of baffles and plexiglass affixed to the corner of the drum riser, muffling the drum with a towel or other cloth taped to or laid over the drum, and asking drummers to play quieter. However, adhesive devices can leave a residue on the drum head which can undesirably affect the tonal qualities of the drum, while the use of available baffles and physical barriers are inconvenient. Available muffling devices can also come detached or unfastened from the drum, especially during a vigorous performance, and playing more quietly is simply undesirable for many musicians.

Accordingly, what is needed are improvements in devices and methods for damping drums.

BRIEF SUMMARY OF THE INVENTION

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

It is an object of the present invention to provide a device or apparatus that will prevent or block loud piercing notes commonly emitted from various percussive musical instruments, particularly including snare drums, from discomforting attendees of live musical performances located near the stage. It is another object of the present invention to prevent such loud piercing sounds from bleeding into nearby vocal microphones, both during live performances and studio recordings.

Accordingly, one aspect of the invention provides a damper for a drum comprising a flexible body including an upper portion, a lower edge, a left side, and a right side; an elastic cord having a first end and a second end, the cord extending through the upper portion of the body from the left side to the right side such that each end of the cord extends out of a corresponding side of the body; and means for securing the first and second ends of the cord to a portion of the drum; wherein the lower edge of the body hangs below a bottom surface of the drum when the first and second ends of the cord are secured to the drum. When connected to a drum, such as a snare drum, the portion of the flexible body hanging below the bottom surface of the drum absorbs the undesirable piercing notes emitted from the bottom of the drum head while the drum is being played.

Numerous other objects, advantages and features of the present disclosure will be readily apparent to those of skill in the art upon a review of the following drawings and description of a preferred embodiment.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION OF THE INVENTION

While the making and using of various embodiments of the present invention are discussed in detail below, it should be appreciated that the present invention provides many applicable inventive concepts that can be embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

To facilitate the understanding of the embodiments described herein, a number of terms are defined below. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
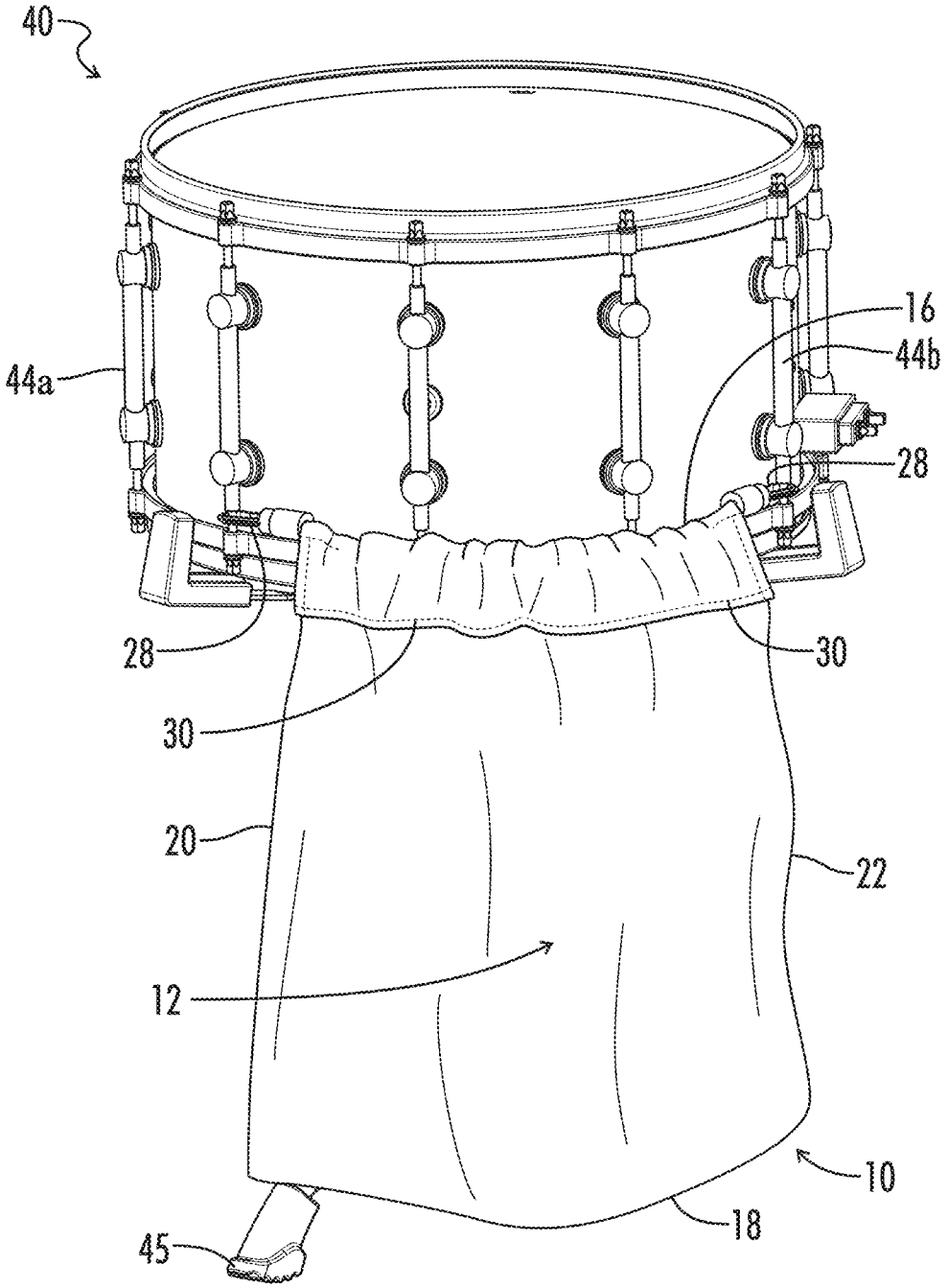
FIG. 1 is a front perspective view of a drum damper formed in accordance with one embodiment of the present invention releasably attached to the front of a common snare drum.
Figure 2:
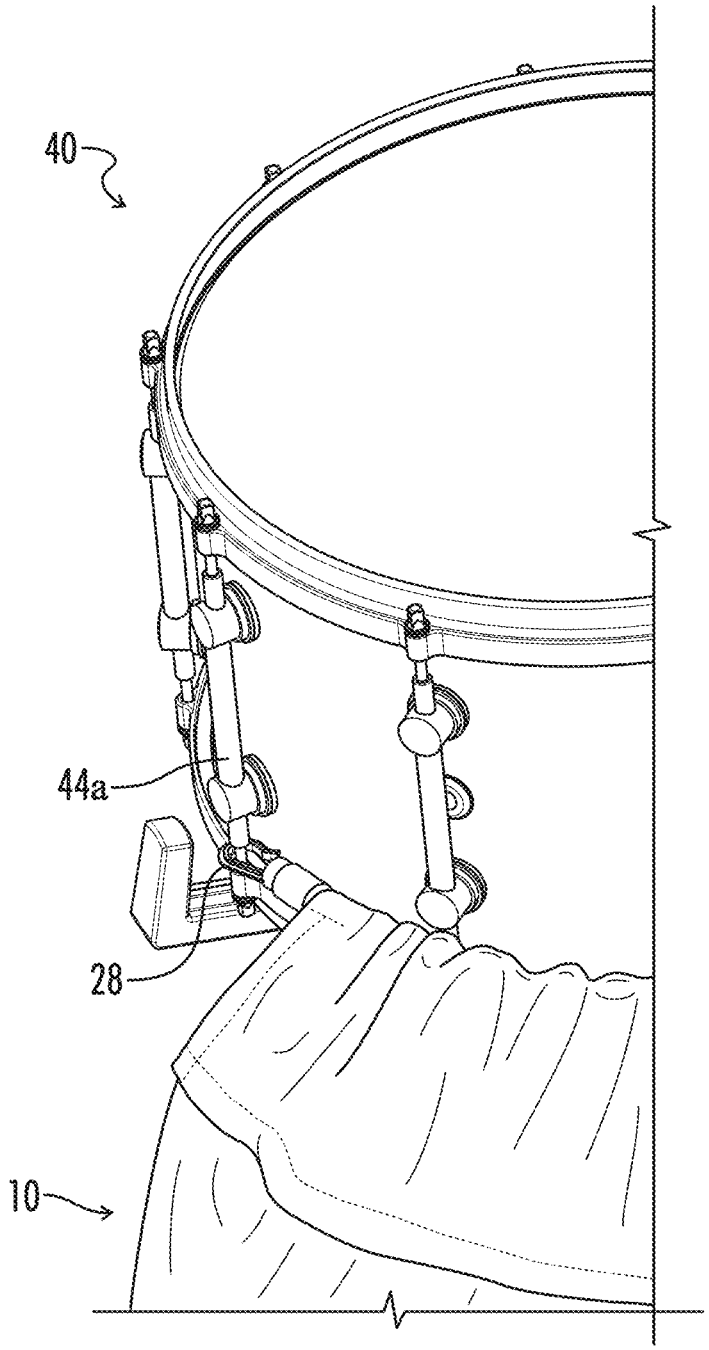
FIG. 2 is detail view of the objects of FIG. 1 illustrating attachment of the left side of the drum damper of FIG. 1 to a lug on the front of the snare drum.
Figure 3:
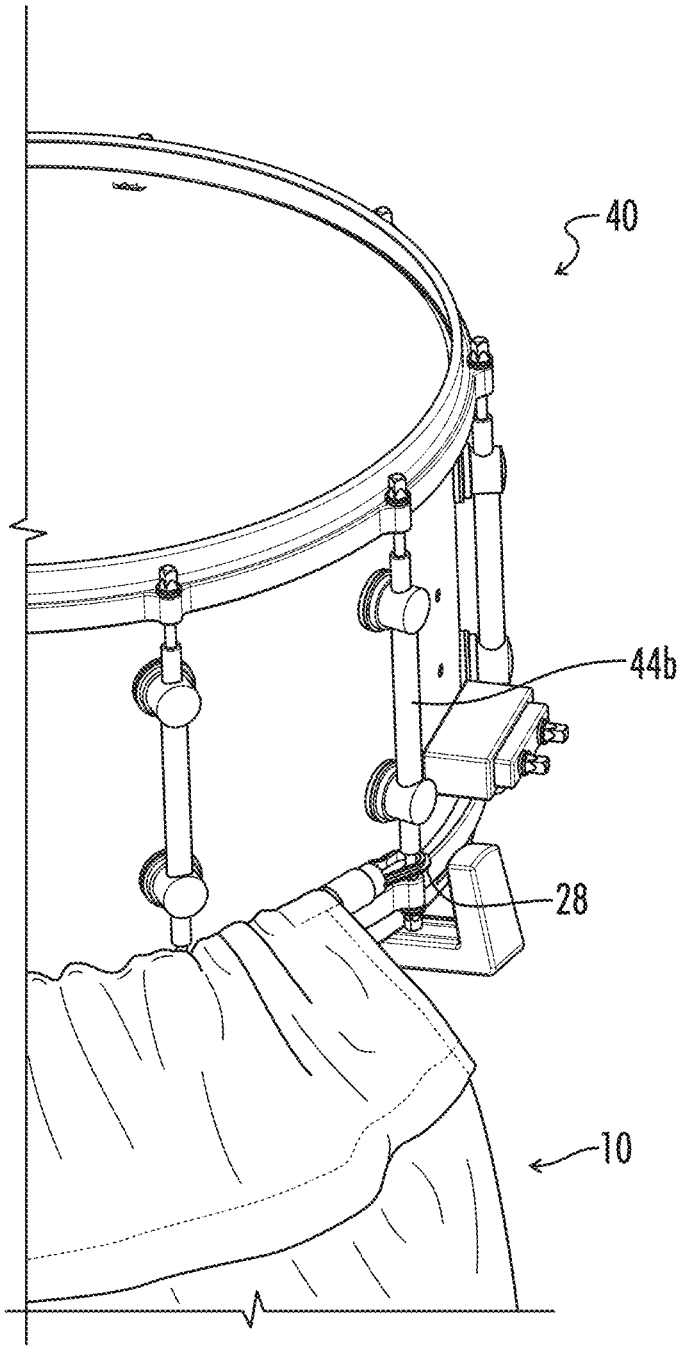
FIG. 3 is another detail view of the objects of FIG. 1 illustrating attachment of the right side of the drum damper of FIG. 1 to a different lug on the front of the snare drum.
Figure 4:
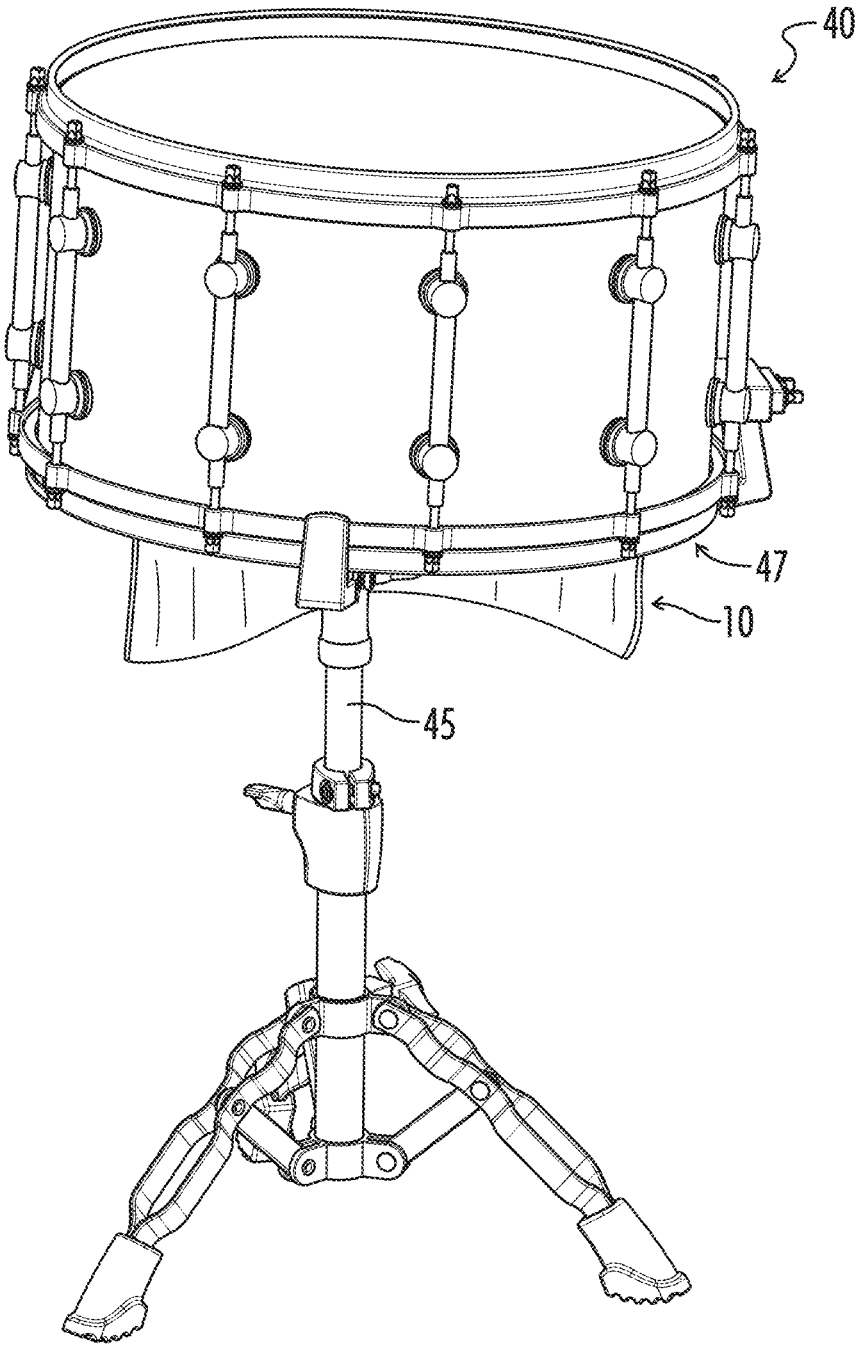
FIG. 4 is a rear perspective view of the objects of FIG. 1.
Figure 5:
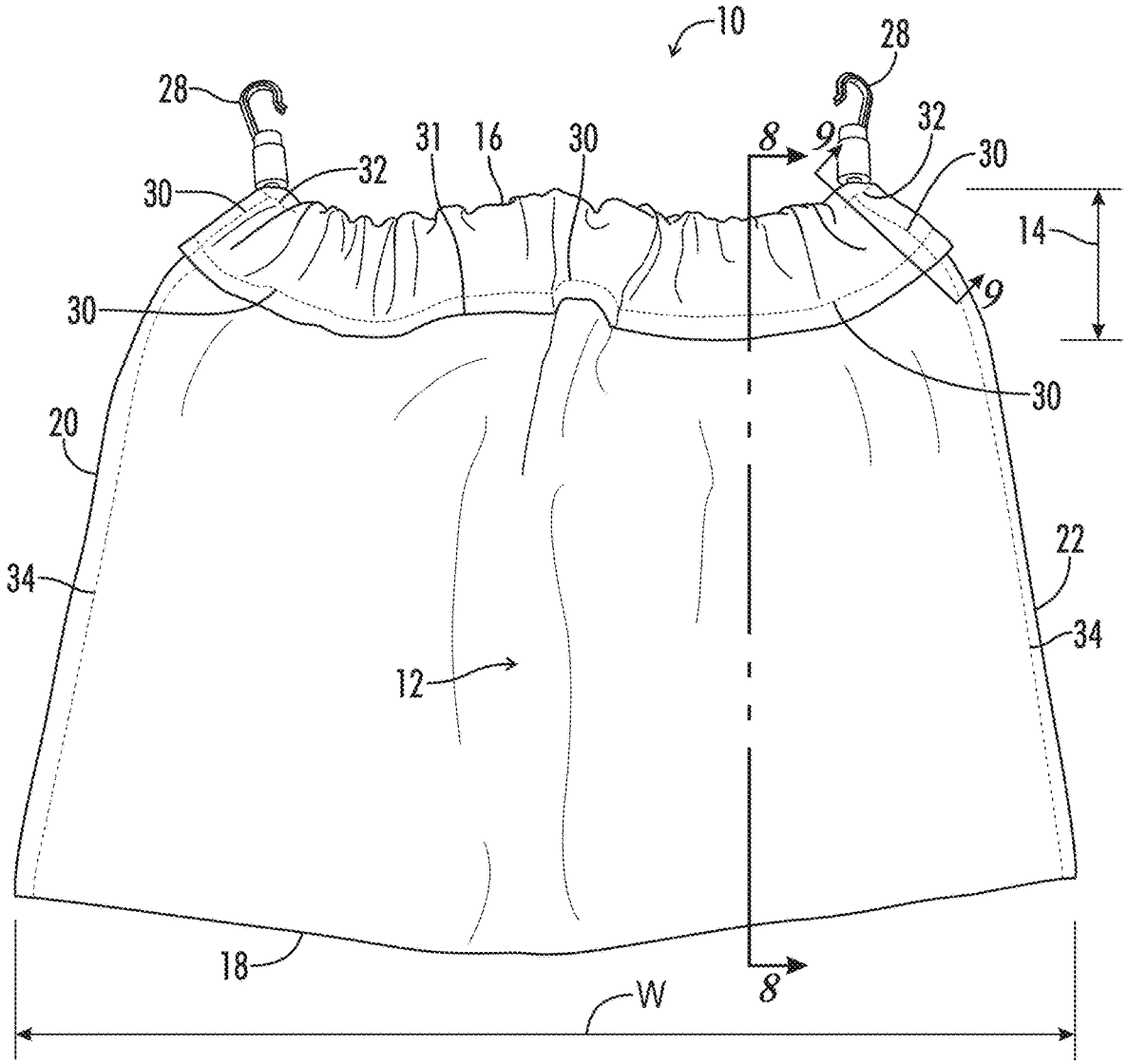
FIG. 5 is a front elevational view of the drum damper of FIG. 1.
Figure 6:
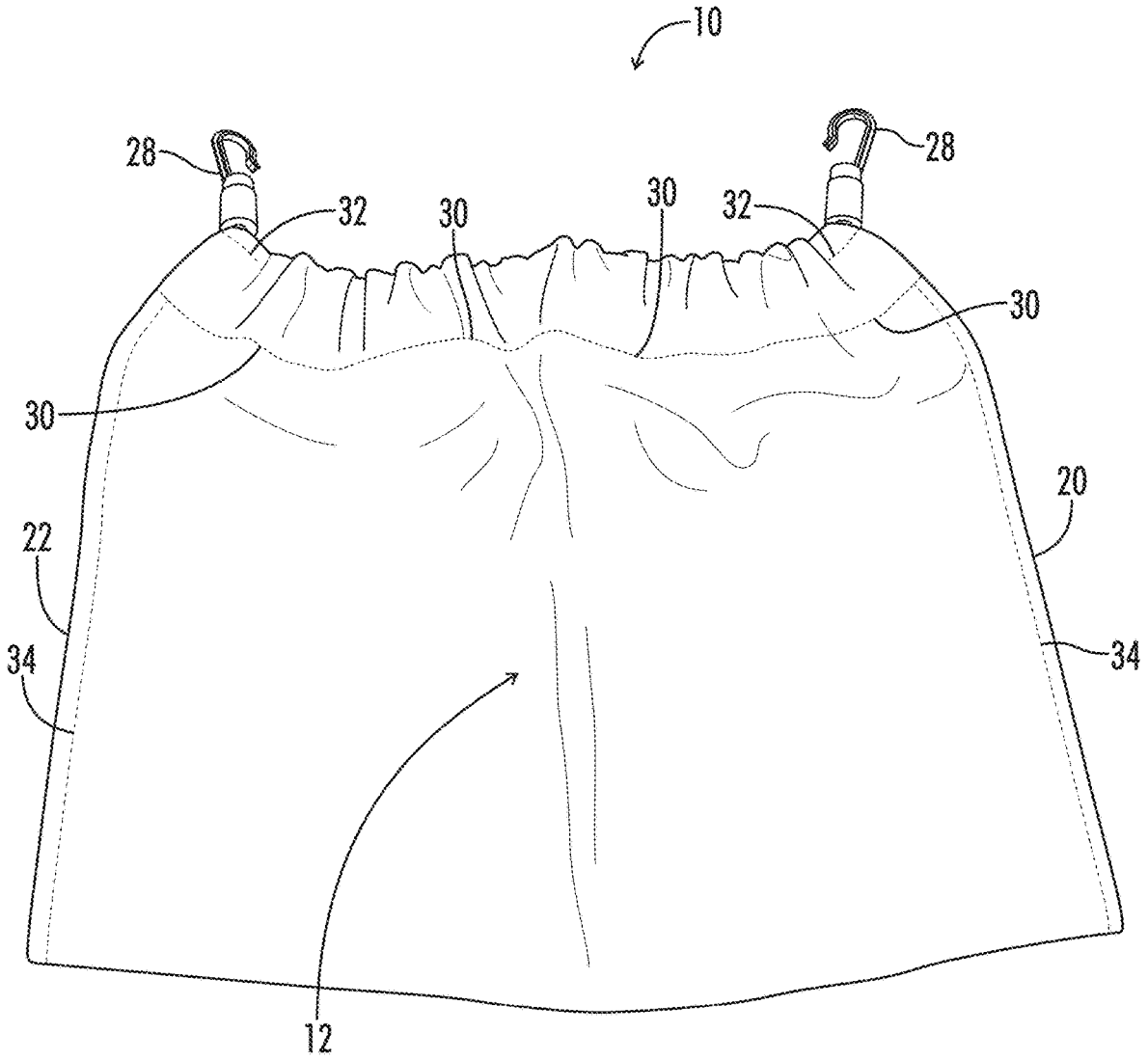
FIG. 6 is a rear elevational view of the drum damper of FIG. 1.
Figure 7:
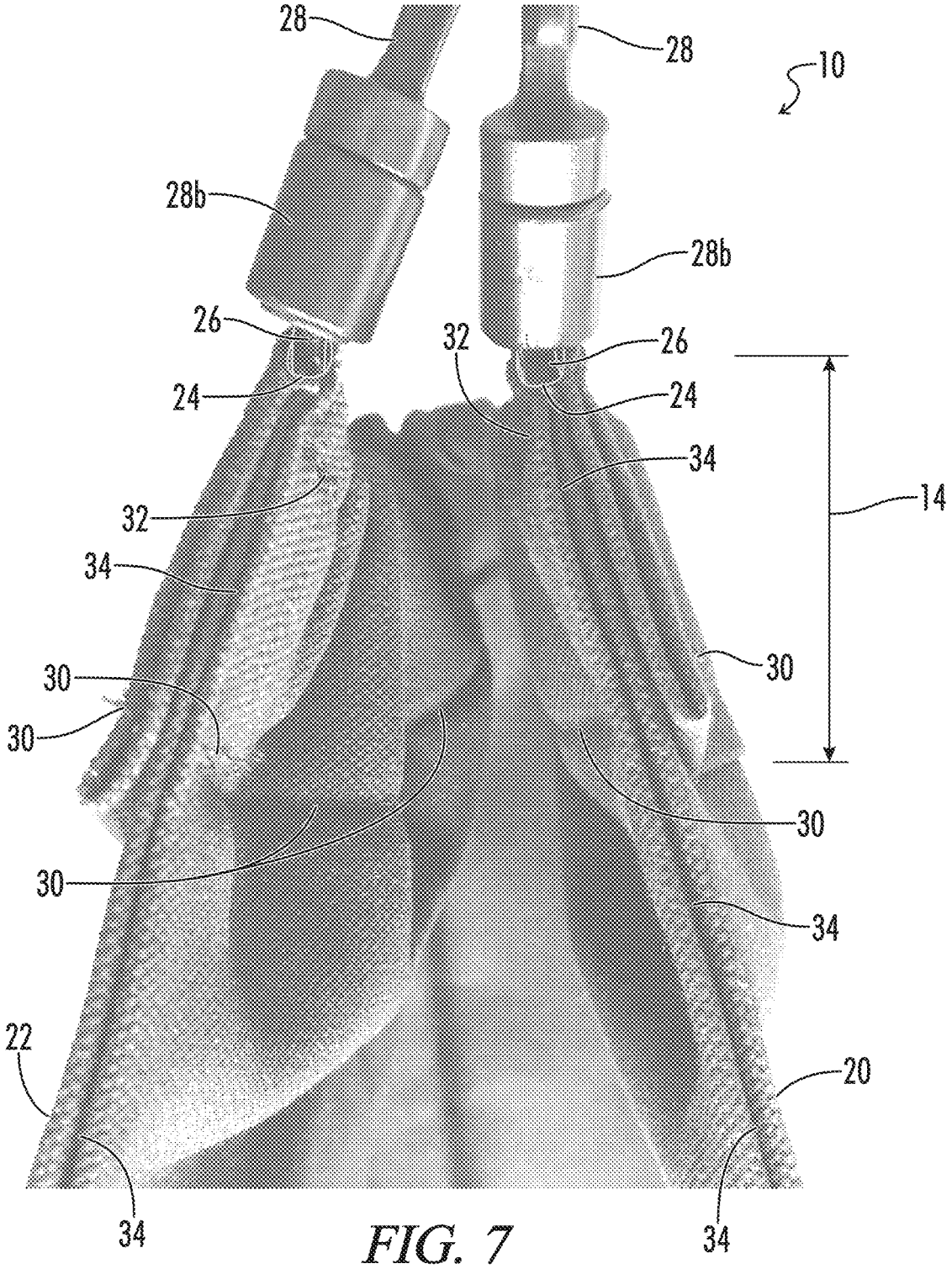
FIG. 7 is a close-up rear perspective view of the upper portion of the drum damper of FIG. 1 showing the drum damper folded in half from side to side to illustrate how the upper portion of the panel forming the main body of the damper is folded over the elastic cord to which the hooks are attached.
Figure 8:
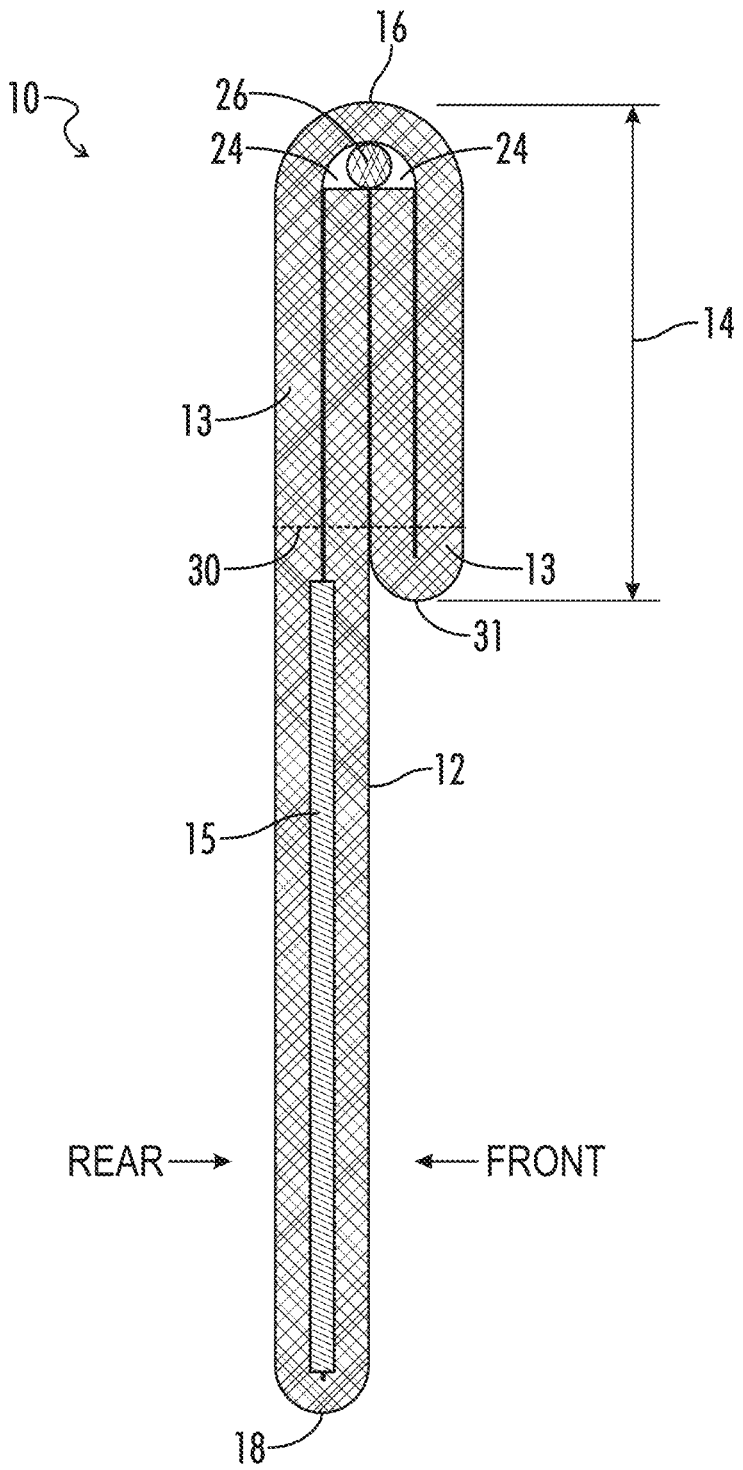
FIG. 8 is a diagrammatic sectional view taken along line 8-8 of FIG. 5 which shows how a single panel can be folded and stitched to form the main body and passage in which the elastic cord is received. Hooks are omitted for clarity.
Figure 9:
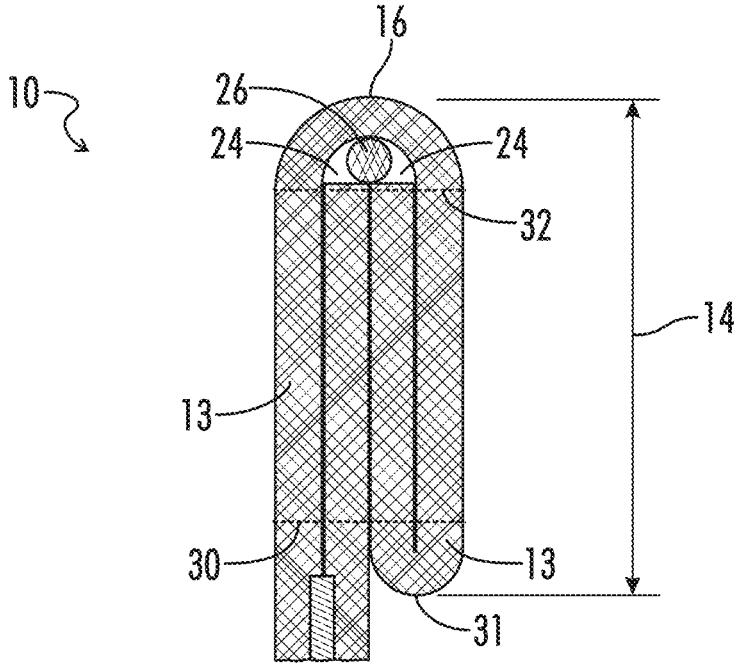
FIG. 9 is a fragmentary diagrammatic sectional view taken along line 9-9 of FIG. 5 and illustrates the placement of stitching to secure folds of the panel together to form and reinforce the passage. Hooks are omitted for clarity.

As described herein, an upright position is considered to be the position of apparatus components while in proper operation or in a natural resting position as described herein. Vertical, horizontal, above, below, side, top, bottom and other orientation terms are described with respect to this upright position during operation unless otherwise specified. The upright position of the drum damper is determined when the device is installed on a musical instrument as shown in FIG. 1. The term "when" is used to specify orientation for relative positions of components, not as a temporal limitation of the claims or apparatus described and claimed herein unless otherwise specified. The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include logic for deciding, with or without operator input or prompting, whether these features, elements and/or states are included or are to be performed in any particular embodiment.

The end quotation symbol " is used herein to indicate a measurement in standard inches. Unless otherwise indicated, all numbers expressing physical dimensions, quantities of components, mass, and so forth used in the specification and claims are to be understood as being modified in all instances by the term "about". Accordingly, unless indicated to the contrary, the numerical parameters set forth in this specification and claims are approximations that can vary depending upon the desired properties sought to be obtained by the presently disclosed subject matter.

As used herein, the term "panel" means a sheet of a flexible material, such as textile, cloth, fabric, leather, and the like. Suitable flexible materials can be formed from natural or synthetic substances, and can be woven or non-woven.

As used herein, the term "about," when referring to a value or to an amount of mass, weight, time, volume, concentration, percentage or a physical dimension such as length, width, or diameter, is meant to encompass variations of in some embodiments+−40% or more, in some embodiments+−20%, in some embodiments+−10%, in some embodiments+−5%, in some embodiments+−1%, in some embodiments+−0.5%, and in some embodiments+−0.1% from the specified value or amount, as such variations are appropriate to perform the disclosed methods.

As used herein, ranges can be expressed as from "about" one particular value, and/or to "about" another particular value. It is also understood that there are a number of values disclosed herein, and that each value is also herein disclosed as "about" that particular value in addition to the value itself. For example, if the value "10" is disclosed, then "about 10" is also disclosed. It is also understood that each unit between two particular units are also disclosed. For example, if 10 and 15 are disclosed, then 11, 12, 13, and 14 are also disclosed.

In one embodiment, a drum damper 10 is a sound damping device configured to be releasably attached to and hang from lugs on the front of a drum. When releasably connected to lugs 44*a*, 44*b* on the bottom rim of a common snare drum 40 as shown in FIGS. 1-4, the drum damper 10 discretely hangs down below the bottom surface 47 of the drum head to reduce or eliminate the perception by nearby people and vocal microphones of uncomfortably loud piercing notes emitted from the lower surface of the drum. Although the drum damper 10 is shown in FIG. 1 as releasably attached to lugs 44 on the front of a common snare drum 40, the drum damper 10 can be dimensionally configured to mount to and modulate the tonal qualities of drums of all types and sizes, including but not limited to timbale drums.

The drum damper 10 of the present invention advantageously has a very low profile, takes up no floorspace, does not leave a sticky adhesive residue when removed, and does not prevent or interfere with use of a tripod or other stand 45 to hold the drum 40 for use by a musician during a live performance. The drum damper 10 can also be quickly and easily attached, detached, and reattached to any portion of a drum, including a drum forming part of a drum set, where noise reduction is needed most, for example, hanging in the space between the kick drum and high-hat stand on a drum set. The drum damper 10 does not require a drummer to change anything about how he or she plays (e.g., the volume at which the drum is played), and has negligible effect on the way a drummer or other musician hears the instrument to which the drum damper 10 is attached.

As shown in FIGS. 5-9, the drum damper 10 includes a flexible main body 12 having an upper portion 14 with an upper edge 16, a lower edge 18, a left side 20, and a right side 22. The body 12 has a width W extending from the left side 20 to the right side 22, and a height H extending from the upper edge 16 to the lower edge 18. The upper portion 14 of the body 12 includes a continuous enclosed elongated passage 24 that extends through the body from the left side 20 to the right side 22. An elastic cord 26, which in some embodiments can be a bungee cord, is received in the passage 24. The cord 26 includes opposing ends which extend out of the corresponding ends of the passage 24 from either side of the body 12. Means for releasably attaching each end of the cord 26 to the lugs 44 of a drum 40 are secured to each end of the cord 26. In some embodiments, as shown in FIGS. 1-7, the means for releasably attaching the cord to the drum can be a tongueless shock cord hook 28. In other embodiments, the means for releasably attaching the cord 26 to the lugs 44 of a drum 40 can be shaped so as to attach the cord to a different portion of the drum 40 or a different portion of a different musical instrument.

Although the passage is depicted herein as a continuous enclosed passage 24, in alternate embodiments, it is envisioned that the passage can be a discontinuous and/or unenclosed passage. For example, in some alternate embodiments, the passage can be formed by a series of grommets (not shown) fixed to the upper portion 14 of the body 12. In such embodiments, the cord 26 can extend through the series of grommets in a manner similar to that of a curtain rod extending through grommeted drapes or curtains. However, it is believed that the continuous enclosed passage 24 depicted herein better protects the elastic cord 26 from damage (e.g., fraying) during use than would a passage formed by grommets.

The body 12 can be formed from one or more panels of any flexible, sound damping material, such as a textile or other material capable of absorbing vibrations emitted by a musical instrument. In some embodiments, the body 12 can be formed from a single panel 13 of a durable fabric such as canvas or duck cloth which is folded and secured together in one or more places. In some embodiments, the durable fabric can be folded and secured together in one or more places using stitching 30 as further described below. In other embodiments, the durable fabric can be folded and secured together using an adhesive. In still yet other embodiments, the durable fabric can be a heat reactive material which fuses to itself upon the application of heat and pressure.

In a particular embodiment, the body 12 can be formed from a single panel 13 of black duck cloth 26" long by 17" wide. The panel 13 can be folded according to the sectional diagram shown in FIG. 8 and sewn with stitching 30, 32, 34 where indicated in FIGS. 5-9 to form the main body 12 with a length of about 16" and a height of about 12". In such embodiment, the main body 12 forms a substantially rectangular pouch defining an enclosed or sealed interior space in which a liner 15 formed of a sound dampening material is received. The portion of the panel 13 forming the upper portion 14 of the main body 12 is a fold of the panel 13 in that it is folded over and around the cord 26 to form passage 24.

Referring again to FIGS. 5-9, stitching 30, 32 extends through and holds together all four folded layers of the panel 13 forming the upper portion 14 of main body 12. Stitching 30 extends along the lower edge 31 and the sides 20, 22 of the upper portion 14, whereas stitching 32 extends inwardly a short distance (e.g., from about 1" to about 2") from either side 20, 22 of the main body just below (i.e., adjacent to) the passage 24. Stitching 32 is situated where shown in FIGS. 5-7 and 9 so as to limit or constrict the diameter of the passage 24 to a size less than the diameter of the base portion **28*b* of each hook 28 to which the ends of the cord 26 are secured. In this way, the stitching 32 defines a portion of the passage 24 and prevents the opposing ends of cord 26 (and thus hooks 28) from undesirably retracting into and becoming lost or bunched inside the passage 24. Stitching 32 also simultaneously strengthens the upper portion 14 of the drum damper 10 and prevents accidental tearing during use. Stitching 30, 32 is visible from both the front and rear exterior surfaces of the drum damper 10. By contrast, stitching 34 is blind stitching and is thus not normally visible from either the front or rear exterior surfaces of the drum damper 10. Blind stitching 34 extends through two hidden (i.e., interior) folded layers of the panel 13 forming drum damper 10 along the left and right sides 20, 22 of the main body 12 where indicated in FIGS. 5 and 6 by dashed lines. All stitching 30, 32, 34 used to form the drum damper 10** can be of the same or different constituent materials.

The liner 15 can be one or more layers of a heat fusible material, such as Fusible Thermolam® Plus, to help absorb the undesirably piercing sound emitted from the bottom of the drum head. The liner 15 can be secured to (e.g., fused to or ironed on) a surface of the panel 13 before sewing or stitching so that the liner 15 does not move around or pile up while inside the interior space of the body 12. This ensures maximum and reliable sound dampening while the drum damper 10 is releasably secured to the drum 40. In one embodiment, the liner (i.e., fusible material) can have a length of about 15" and a height of about 11".

In some embodiments, the elastic cord 26 can have a length less than the width W of main body 12 in order to ensure that the damper 10 snugly and securely fits and covers the desired area of the drum 40 to which the damper is to be releasably attached. Use of a cord 26 shorter than the width W of the main body 12 also ensures that the hooks 28 coupled to each end of the cord 26 are maintained in tension against the lugs **44*a*, 44*b* on drum 40 or other portion of a different musical instrument. In one embodiment, the cord 26** can be a bungee cord having a length of about 13" and a diameter of about ⅛".

In additional embodiments, the damper 10 can be include a vertical slit extending from the center of the bottom edge 18 a distance toward the upper portion 14 in order to accommodate drums with microphone stands or other devices extending outward from the drum (not shown).

The damper 10 disclosed herein is not limited to use with drums or the attachment means depicted in the appended figures. Rather, the damper 10 disclosed herein can be used to effectively modulate the tonal qualities of additional musical instruments, including other percussive instruments. Additionally, the size of the main body 12 of the damper 10 can be varied to suit the relative size of the instrument to which the damper is intended to be releasably attached.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific procedures described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention it is not intended that such references be construed as limitations upon the scope of this invention except as set forth in the following

What is claimed is:

1. A damper for a drum, comprising:

a flexible body formed from a panel of sound damping material, the body defining an interior space and including a lower edge, a left side, a right side, an upper portion extending from the left side to the right side, and a passage extending through the upper portion from the left side to the right side of the body;

a sound damping liner received in the interior space;

an elastic cord received in the passage, the cord having a first end and a second end, the cord extending through the passage such that each end of the cord extends beyond the corresponding left or right side of the body; and means for connecting the cord to the drum secured to the first and second ends of the cord;

wherein the lower edge of the body hangs below a bottom surface of the drum when the first and second ends of the cord are connected to the drum.

2. The drum damper of claim 1, wherein the passage is a continuous passage defined by a fold of the panel which forms the upper portion of the body.

3. The drum damper of claim 1, wherein:

the body has a width extending from the left side to the right side;

the cord has a length extending from the first end to the second end; and the length of the cord is less than the width of the body.

4. The drum damper of claim 3, wherein the means for connecting the cord to the drum prevents the first and second ends of the cord from retracting into the passage.

5. The drum damper of claim 4, wherein the means for connecting the cord to the drum is a hook secured to each of the first and second ends of the cord.

6. The drum damper of claim 5, wherein a base portion of each hook has a diameter greater than a diameter of the passage.

7. The drum damper of claim 1, wherein the liner is secured to a portion of the panel forming an interior surface of the interior space.

8. A damper for a drum, comprising:

a flexible sheet of sound damping material;

an elastic cord having a first end and a second end; and a hook secured to each of the first and second ends of the cord; wherein:

the sheet is folded and stitched to form a rectangular body including an upper portion defining a continuous passage extending from a left side to a right side of the body;

the cord is received in the passage;

the first and second ends of the cord extend out of the passage from the corresponding left and rights sides of the body such that the hook secured to each end of the cord rests outside the passage; and a lower edge of the body hangs below a bottom surface of the drum when the hooks are connected to the drum.

9. The drum damper of claim 8, wherein:

the body defines an interior space; and the drum damper further comprises a sound damping liner received in the interior space.

10. The drum damper of claim 9, wherein:

the interior space is spaced below the passage; and the liner is enclosed in the interior space.

11. The drum damper of claim 10, wherein the liner is secured to a portion of the sheet forming an interior surface of the interior space.

12. The drum damper of claim 8, wherein:

the body has a width extending from the left side to the right side;

the cord has a length extending from the first end to the second end; and the length of the cord is less than the width of the body.

13. The drum damper of claim 8, wherein each hook includes a base portion sized to prevent the hook from retracting into the passage.

14. The drum damper of claim 8, further comprising horizontal stitching extending through the upper portion of the body, the stitching extending inwardly toward a middle of the body from each of the left and right sides, the stitching defining a portion of the passage and constricting a diameter of the passage to less than a diameter of the hooks so as to prevent the hooks from retracting into the passage.

15. A damper for a drum, consisting of:

a sheet of flexible material folded and stitched to form a rectangular body defining a continuous passage and an interior space separated from the passage;

an elastic cord received in the passage;

a pair of hooks secured to the cord; and a sound damping liner received in the interior space; wherein:

the elastic cord includes opposing first and second ends, each of which extends out of the passage from an opposite side of the body;

each hook is secured to an opposite end of the cord; and a lower edge of the body hangs below a bottom surface of the drum when the hooks are connected to the drum.

16. The drum damper of claim 15, wherein the passage extends:

from a left side to a right side of the body, and parallel to the interior space.

17. The drum damper of claim 15, wherein a base portion of each hook has a diameter greater than a diameter of the passage.

* * * * *